US012357873B2

(12) United States Patent
Fredenburg

(10) Patent No.: US 12,357,873 B2
(45) Date of Patent: Jul. 15, 2025

(54) LEVERAGE TRAINING SLED

(71) Applicant: Gary Dawayne Fredenburg, Belton, TX (US)

(72) Inventor: Gary Dawayne Fredenburg, Belton, TX (US)

( * ) Notice: Subject to any disclaimer, the term of this patent is extended or adjusted under 35 U.S.C. 154(b) by 193 days.

(21) Appl. No.: 18/352,950

(22) Filed: Jul. 14, 2023

(65) Prior Publication Data

US 2024/0017122 A1 Jan. 18, 2024

Related U.S. Application Data

(60) Provisional application No. 63/389,776, filed on Jul. 15, 2022.

(51) Int. Cl.
*A63B 23/04* (2006.01)
*A63B 69/34* (2006.01)

(52) U.S. Cl.
CPC ..... *A63B 23/047* (2013.01); *A63B 69/34* (2013.01); *A63B 2220/53* (2013.01); *A63B 2225/093* (2013.01)

(58) Field of Classification Search
CPC ..... A63B 21/0004; A63B 21/4023; A63B 23/047; A63B 69/34; A63B 71/03; A63B 2220/50; A63B 2220/51; A63B 2220/53; A63B 2225/093
See application file for complete search history.

(56) References Cited

U.S. PATENT DOCUMENTS

| | | | | |
|---|---|---|---|---|
| 2,558,081 A * | 6/1951 | Gardenhour | A63B 69/34 | 473/445 |
| 3,365,947 A * | 1/1968 | Chaverini | A63B 69/34 | 473/441 |
| 3,425,692 A * | 2/1969 | Leach | A63B 69/34 | 473/445 |
| 3,514,105 A * | 5/1970 | Pillard | A63B 69/34 | 473/441 |
| 3,907,291 A * | 9/1975 | Parker | A63B 69/34 | 473/445 |
| 4,508,341 A * | 4/1985 | Carrington | A63B 69/34 | 482/130 |
| 5,013,039 A * | 5/1991 | Cole | A63B 69/34 | 473/445 |
| 9,566,492 B1 * | 2/2017 | Dunning | A63B 69/34 | |
| 10,561,919 B1 * | 2/2020 | Huff | A63B 69/34 | |

(Continued)

*Primary Examiner* — Gary D Urbiel Goldner
(74) *Attorney, Agent, or Firm* — Foley & Lardner LLP

(57) ABSTRACT

A leverage training sled includes a first elongate member separated by a distance from a second elongate member that allows for the leverage training sled to slide along a ground surface. The leverage training sled also includes a cross member, a contact member, an upright member, and a bladder member. The cross member has a first end adjacent to a portion of the first elongate member and a second end adjacent to a portion of the second elongate member. The contact member extends from a portion of the cross member at a first angle relative to the cross member and is configured to pivot from the first angle to a second angle. The upright member also extends from the portion of the cross member. The bladder member is positioned at a height between a portion of the upright member and a portion of the contact member.

20 Claims, 6 Drawing Sheets

(56) References Cited

U.S. PATENT DOCUMENTS

| | | | | |
|---|---|---|---|---|
| 2002/0147061 | A1* | 10/2002 | Krause | A63B 69/34<br>473/445 |
| 2011/0124474 | A1* | 5/2011 | Gilman | A63B 21/0618<br>482/93 |
| 2013/0143693 | A1* | 6/2013 | Forrest, Sr. | A63B 69/34<br>473/444 |
| 2019/0262689 | A1* | 8/2019 | Gray | A63B 23/047 |
| 2019/0275364 | A1* | 9/2019 | Saunders | A63B 21/0004 |

* cited by examiner

LEVERAGE TRAINING SLED

CROSS-REFERENCE TO RELATED PATENT APPLICATIONS

This application is a claims priority to and the benefit of U.S. Provisional Application No. 63/389,776, filed Jul. 15, 2022, which is incorporated herein by reference in its entirety for all purposes.

BACKGROUND

The present invention relates generally to the field of sport training sleds. Sport training sleds specifically configured to train football players generally require a padded front member for the player to hit, contact, or collide with to train certain block shedding techniques.

Predominantly, football training sleds train the large leg muscle groups such as the quadriceps and hamstrings by having the player contact the front padded member and push a weighted sled a distance. Such sleds as known in the art do not include any apparatus or structure to train football to take positions or actions on the field from a lowered position to gain leverage on an opposing player.

The majority of football training sleds position the biasing member relatively high up on the training sled. This configuration is suitable for training players to push heavy objects over longer distances but falls short in training capacity of training players to use muscle groups associated with the hips for fast twitch motions.

SUMMARY OF THE INVENTION

According to a first aspect, a sled includes a first elongate member separated by a distance from a second elongate member and a cross member having a first end adjacent to a portion of the first elongate member and a second end adjacent to a portion of the second elongate member. The sled also includes a contact member with a first end, wherein the first end is positioned adjacent to a portion of the cross member, wherein the contact member is positioned at a first angle relative to the cross member and is configured to pivot from the first angle to a second angle. The sled further includes an upright member that extends from a portion of the cross member, and a bladder member is positioned at a height between a portion of the upright member and a portion of the contact member.

In other embodiments, the first and second elongate members are cylinders.

According to some embodiments, the sled further includes a deck portion configured to be positioned above a portion of the cross member.

In yet another embodiment, the cross member is a plurality of cross members.

In some embodiments, the bladder member is an adjustable air spring, wherein the adjustable air spring is configured to adjust a pressure of the air spring from at least first pressure to at least a second pressure.

In other embodiments, the cross member is positioned about perpendicular to the first elongate member and the second elongate member.

According to some embodiments, wherein the sled further includes a pivot pin positioned adjacent to a portion of the cross member. In some embodiments, a portion of the pivot pin is configured to receive a lubricant.

In yet another embodiment, the sled further includes a brace that extends between a portion of the upright member and a portion of the deck portion.

In some embodiments, the sled further includes a friction increasing member connected to the deck portion.

According to another aspect, a method of manufacturing a sled, includes the steps of providing a first elongate member separated by a distance from a second elongate member and providing a cross member having a first end adjacent to a portion of the first elongate member and a second end adjacent to a portion of the second elongate member. The method also includes the steps of providing a contact member with a first end, wherein the first end is positioned adjacent to a portion of the cross member, wherein the contact member is positioned at a first angle relative to the cross member and is configured to pivot from the first angle to a second angle. The method further includes the steps of providing an upright member that extends from a portion of the cross member and providing a bladder member that extends between a portion of the upright member and a portion of the contact member.

In other embodiments, the first and second elongate members provided by the method are cylinders.

According to some embodiments, the method further includes the step of providing a deck portion configured to be positioned above a portion of the cross member.

In yet another embodiment, the cross member provided by the method is a plurality of cross members.

In some embodiments, the bladder member provided by the method is an adjustable air spring, the adjustable air spring configured to adjust a pressure of the bladder member from at least a first pressure to at least a second pressure.

In other embodiments, the method further includes the step of providing a pivot pin adjacent to a portion of the cross member.

According to some embodiments, a portion of the pivot pin provided by the method is configured to receive a lubricant.

In yet another embodiment, the method further includes the step of affixing a friction increasing member connected to the deck portion.

According to yet another aspect, a leverage training sled includes a first sliding member, a second sliding member, the second sliding member spaced apart from the first sliding member by a length, and a support member connected to a portion of the first sliding member and to a portion of the second sliding member. The leverage training sled also includes a collision member with a first end, the first end positioned adjacent to a portion of the support member, wherein the collision member is positioned relative to the support member at an angle and a pivot member connected to a portion of the deck portion and an end of the collision member, the pivot member configured to receive a lubricant. The leverage training sled also includes a column that extends substantially vertically from a portion of the support member and a bladder having an internal pressure and that extends between a portion of the column and a lower portion of the collision member. The leverage training sled further includes a sensor configured to record a value associated with the collision member.

In other embodiments, the value that is recorded by sensor is a force.

According to some embodiments, the internal pressure of the bladder can be increased or decreased an amount.

In yet another embodiment, the leverage training sled further includes a padded member removably affixed to the front of the collision member.

In some embodiments, the padded member includes a visual indicator on a front face of the padded member.

In other embodiments, the bladder is a plurality of bladders.

According to some embodiments, the pivot member includes a removable pivot pin.

BRIEF DESCRIPTION OF THE DRAWINGS

The disclosure will become more fully understood from the following detailed description, taken in conjunction with the accompanying figures, wherein like reference numerals refer to like elements, in which.

The drawings are not necessarily to scale and certain features may be shown exaggerated in scale or in somewhat schematic form in the interest of clarity and conciseness.

DETAILED DESCRIPTION

Embodiments disclosed herein provide a system, an apparatus, and a method for a leverage training sled system 100. In particular, embodiments disclosed herein provide a leverage training sled system 100 that can be easily utilized to train players of sports to better use leverage and fast twitch muscles. A leverage training sled system 100 includes a bladder member 24 positioned between the contact member 20 and the upright member 18. The bladder member 24 acts to absorb the impact that the player imparts to the leverage training sled system 100 during training sessions and provides resistance to said player. The bladder member 24 is generally positioned near a lower portion of the contact member 20 such that the player must impact the contact member 20 on or near the contact member's 20 lower portion to effectively move the leverage training sled system 100 a distance.

Figure 1:
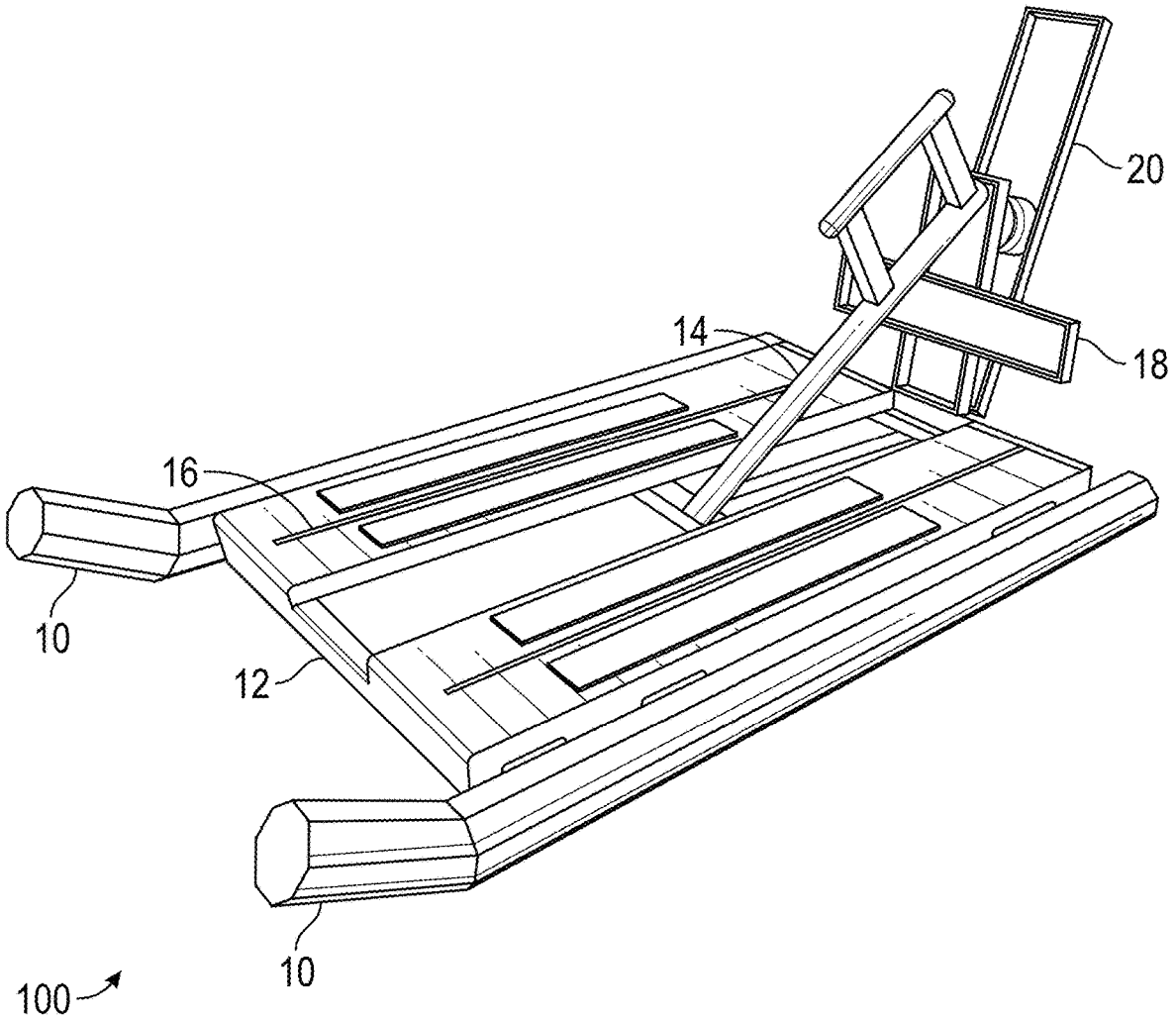
FIG. 1 is a rear side perspective view of an embodiment of a leverage training sled of the present disclosure.
Figure 2:
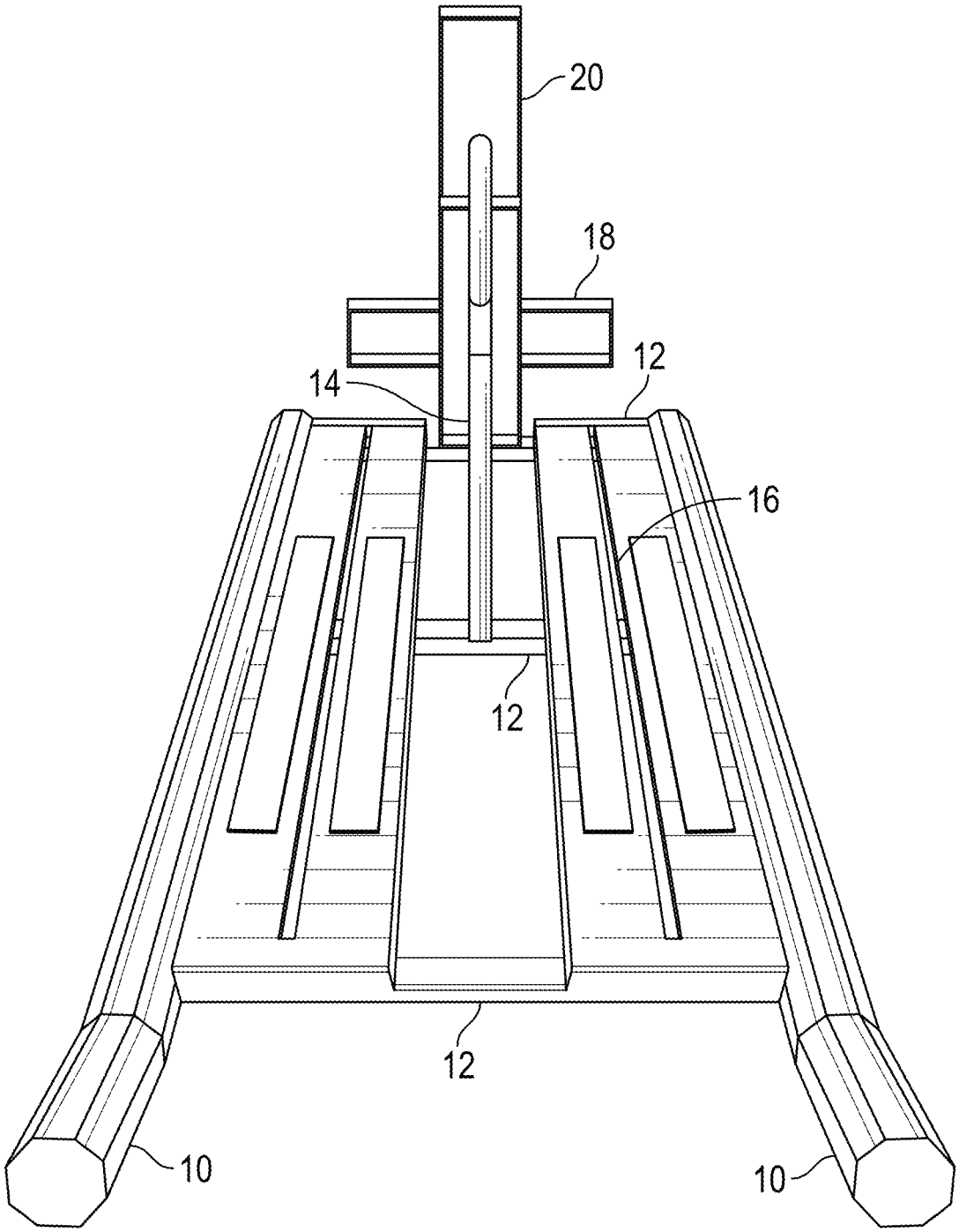
FIG. 2 is a rear perspective view of an embodiment of a leverage training sled of the present disclosure.
Figure 3:
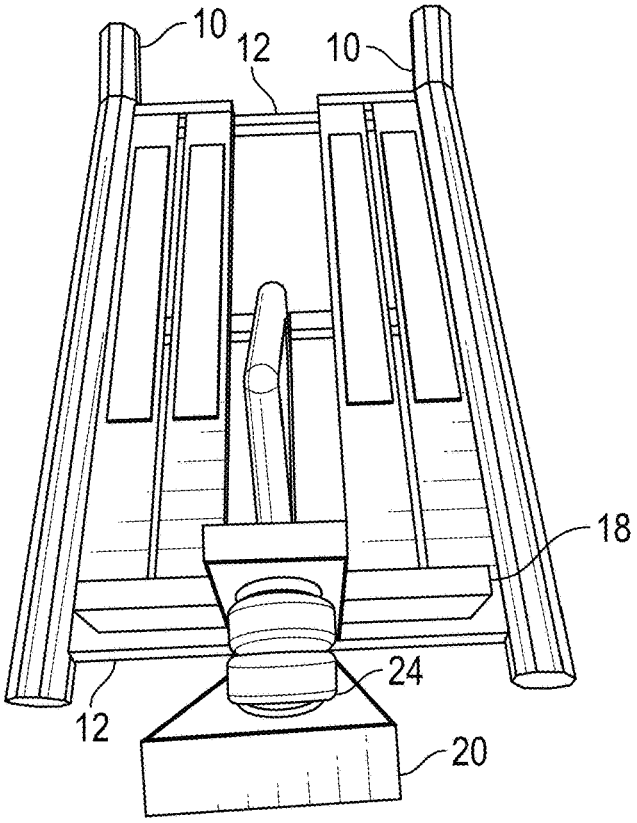
FIG. 3 is a top perspective view of an embodiment of a leverage training sled of the present disclosure.

Reference is now made to FIGS. 1, 2, and 3, respectively depict a rear side perspective view, a rear perspective view, and a front top perspective view of an embodiment of a leverage training sled system 100. The leverage training sled system 100 depicted includes a pair of opposed sliding members 10, a plurality of cross members 12, a bracing member 14, a deck portion 16, an upright member 18, and a contact member 20. The contact member 20 depicted here is connected to a cross member 12 in such a way that the contact member 20 can pivot about the cross member 12 towards the upright member 18.

The opposed pair of sliding members 10 can have a cross sectional shape of a circle, octagon, hexagon, or any other suitable shape such that the siding members do not substantially prevent the leverage training sled system 100 from sliding across the ground when a player imparts a force to the leverage training sled system 100. The cross members 12 function to connect one sliding member 10 to another sliding member 10. The cross member 12 also functions as support for the deck portion 16.

The upright member 18 is rigidly attached to either the cross member 12 or the deck portion 16 such that the upright member 18 can support the bladder member 24 during training sessions and delimit the range of travel that the contact member 20 may move. In some embodiments, the upright member 18 may also have portions that extend horizontally to either side of the contact member 20. The horizontally extending portions may also have a padded member 36 affixed to the front of their respective faces. Such configuration may be necessitated when beginning training sessions with players of different positions. For instance, such a configuration may be necessary when training a player who plays as a defensive lineman. Such horizontal extending portions of the upright member 18 may not be necessary for all players or all positions.

The horizontally extending portions of the upright member 18 may be adjustable vertically on the upright member 18. The horizontally extending portions can have hooks or pins that interface with corresponding through holes or recesses in the upright member 18 so that a horizontally extending portion can be positioned at one height then moved up or down to another height.

The deck portion 16 can be positioned on top of or adjacent to some or all of the cross members 12. The deck portion 16 functions as a platform to provide the coach or trainer an up-close vantage point of the player during the training session. Other embodiments omit the deck portion 16 to reduce the overall weight of the leverage training sled system 100.

The contact member 20 is pivotally attached to a lower portion of the leverage training sled system 100. In the depicted embodiment, the contact member 20 is attached to the pivot member 26 with a pivot pin 28 that extends through a housing 34 of the pivot member 26 and through holes formed in pivot tabs of the contact member 20. The contact member 20 is configured to be struck by a player during a training session, then pivot towards the upright member 18. The bladder member 24 is connected to a lower portion of the contact member 20 to incentivize the player to strike the contact member 20 at a similar or lower height. The higher up the player strikes the contact member 20, the more force the player will have to strike with to achieve a similar result of a player striking with less force but at a lower position of the contact member 20.

Figure 4:
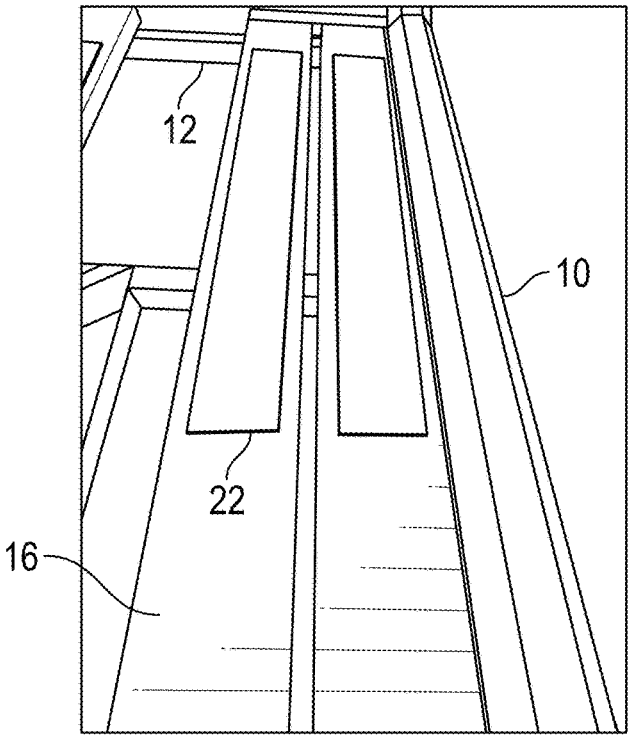
FIG. 4 is a top perspective view of an embodiment of a deck portion of a leverage training sled of the present disclosure.

Reference is now made to FIG. 4, which depicts a top side view of an embodiment of a deck portion 16 with a friction increasing member 22 positioned on top of a portion of the deck portion 16. The friction increasing member 22 functions to increase the friction on sections of the deck portion 16 that a coach or trainer may safely stand on the portions of the deck portion 16 covered by the friction increasing member 22 during a training session with a player.

The increased friction provided by the friction increasing member 22 enhances the stability of the coach standing on the deck portion 16 making it less likely that the coach will slip or fall off of the deck portion 16 while the leverage training sled system 100 is in use. Any suitable kind of friction increasing member 22 can be utilized such as, but not limited to, anti-slip tape or a textured paint.

Figure 5:
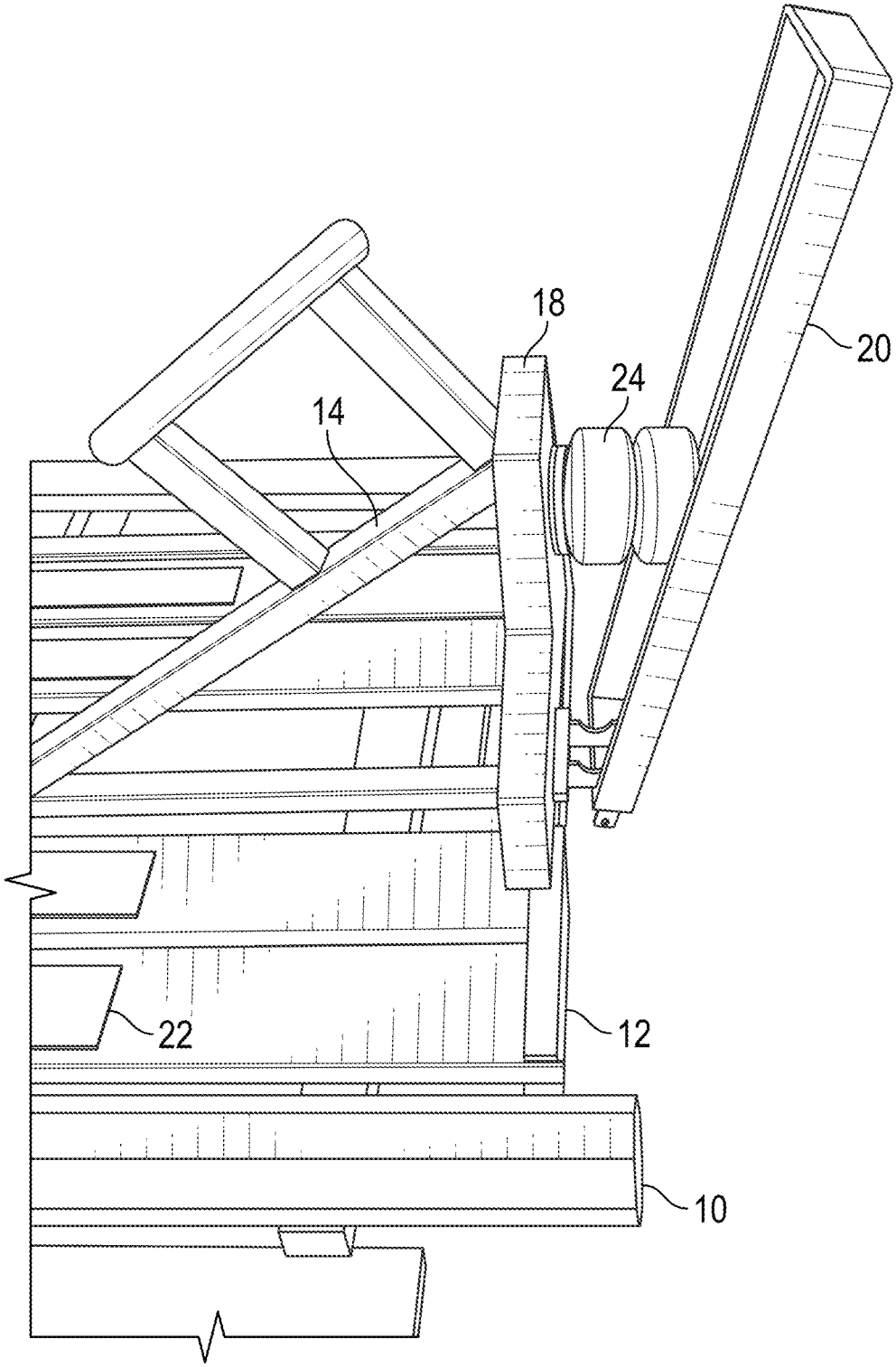
FIG. 5 is a side perspective view of an embodiment of a contact member of a leverage training sled of the present disclosure.

Reference is now made to FIG. 5, which depicts a side perspective view of an embodiment of a bladder member 24 positioned between a contact member 20 and an upright member 18. The bladder member 24 is affixed to a lower portion of the contact member 20 in the depicted embodiment at a single location.

However, in other embodiments, the bladder member's 24 position can be adjusted vertically, such that the bladder member 24 can easily be positioned up or down on the contact member 20 or the upright member 18. To move the bladder member 24 vertically, a track system is affixed to the contact member 20 and a second track system is affixed to the upright member 18, where both track systems are configured to a set number of positions that the bladder member 24 can be set at. The pair of track systems can both be set at the same height or at different heights depending on user preference.

Figure 6:
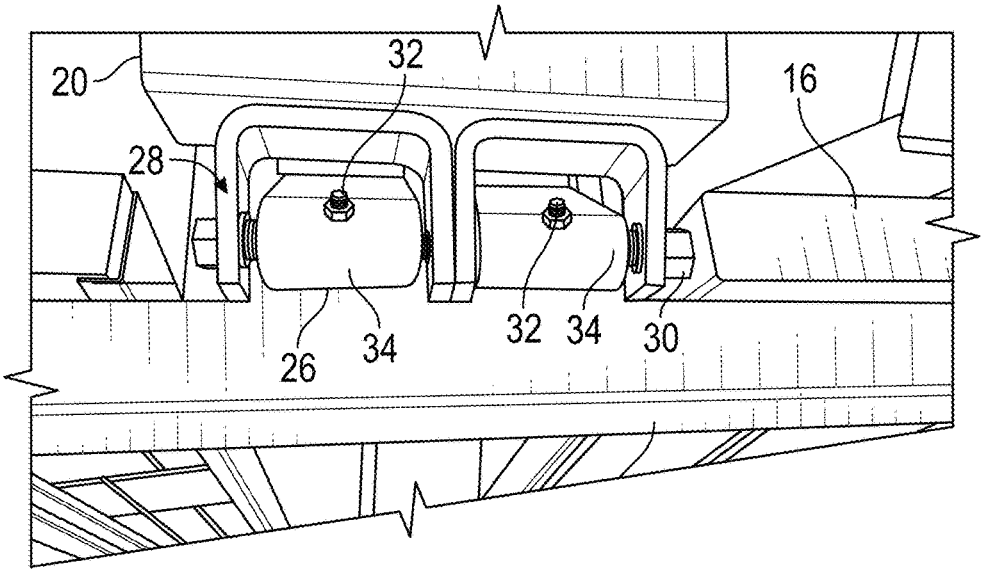
FIG. 6 is a front perspective view of an embodiment of a pivot member of the present disclosure.

Reference is now made to FIG. 6, which depicts a front perspective view of an embodiment of a pivot member 26. In the depicted embodiment, the pivot member 26 is connected to a portion of the front most cross member 12. The pivot member 26 includes a pivot pin 28, a retention member 30, a lubricant injection point 32, and a housing 34. The pivot pin 28 is configured to be inserted through the housing 34 and interface with portions of the contact member 20 and the housing 34 such that the contact member 20 can pivot towards the upright member 18. The lubricant injection point 32 is affixed to a portion of the housing 34 and is configured to accept lubricant from a grease gun or other suitable lubricant injection mechanism.

The pivot pin 28 can be coupled with a retention member 30 such that the retention member 30 prevents the pivot pin 28 from sliding out of the pivot member 26 unexpectedly during player training sessions or other situations where the pivot pin 28 is intended to support the contact member 20.

In certain embodiments, the retention member 30 can be coupled to and removed from the pivot pin 28 without incurring permanent damage. The retention member 30 can be a female threaded member such as a nut. The pivot pin 28 can have a male threaded end such that the retention member 30 can thread on to the male threaded end of the pivot pin 28.

If the pivot pin 28 is removed from the pivot member 26 and the bladder member 24 is de-coupled from the contact member 20, the contact member 20 can be removed such that the leverage training sled system 100 is in a more compact form for shipping or storage.

In the embodiment of the pivot member 26 depicted in FIG. 6, the pivot member 26 includes two separate housings 34 that fit in between three pivot tabs of the contact member 20. In other embodiments, the pivot member 26 may have only a single housing 34 and the contact member 20 may have two pivot tabs. Those in the art understand that the number of housings 34 or pivot tabs of the contact member 20 are not limited to the embodiments depicted or expressly described herein and can be any combination of number of housings 34 and contact member 20 pivot tabs.

Figure 7:
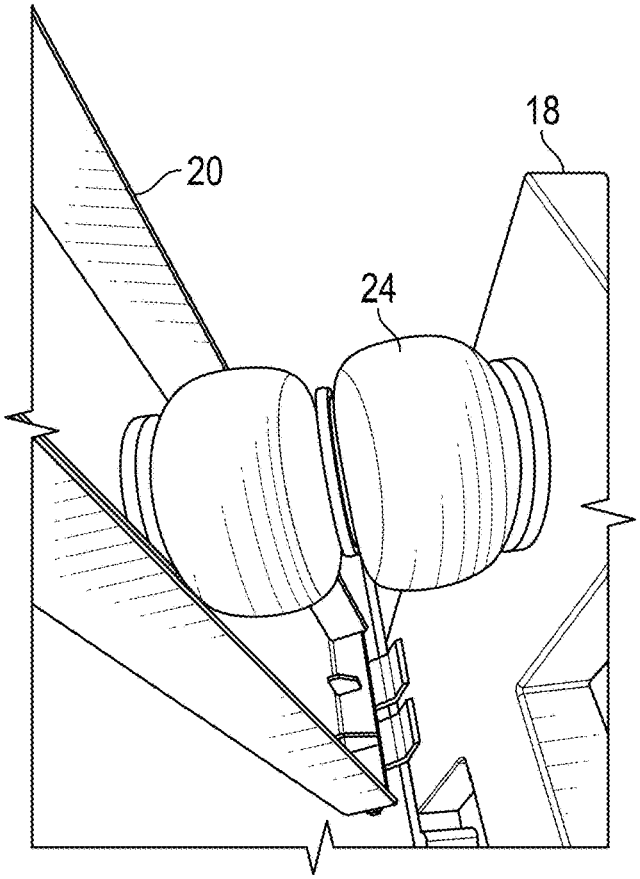
FIG. 7 is a side perspective view of an embodiment of a bladder member of the present disclosure.

Reference is now made to FIG. 7, which depicts a top side perspective view of a bladder member 24 positioned on a lower portion of the contact member 20 and a portion of the upright member 18. The bladder member 24 can be any type of fluid filled biasing mechanism such as, an air spring, air bladder, fluid spring, or fluid bladder. The bladder member 24 has an internal pressure that can be set to a value for a training session with multiple different players or the internal pressure can be increased or decreased to a value that more closely matches any particular player's ability level.

In an embodiment, the bladder member's 24 internal pressure can be adjusted with a bulb pump, or other manual pressure pump, combined with an air release valve and a pressure gauge. In this embodiment, the coach or trainer can increase the internal pressure of the bladder member 24 by pumping the bulb pump until the pressure gauge reaches a desired pressure. The coach or trainer can alternatively decrease the internal pressure of the bladder member 24 by opening the air release valve until the pressure gauge reaches a desired pressure.

According to some embodiments, the bulb pump or manual pump is replaced with an electric pump. In such embodiments, the coach can set a desired pressure on the pump, and the electric pump be configured to maintain that set pressure without further input from the coach or user. The coach can also alter the set pressure of the electronic pump such that the internal pressure of the bladder member 24 is altered for each different player and their respective ability level.

Other embodiments of the leverage training sled system 100 include a plurality of bladder members 24. The plurality of bladder members 24 can be positioned in line vertically with respect to one another, such that one bladder member 24 is positioned higher than the other bladder member 24. The plurality of bladder members 24 can alternatively be positioned in line horizontally with respect to one another. In these embodiments, both bladder members 24 are positioned at approximately the same height relative to the contact member 20 and the upright member 18. In such embodiments, the bladder members 24 can be sized smaller than with embodiments that only utilize a single bladder member 24. The utilization of multiple bladder members 24 increases the safety of the use of the leverage training sled system 100 as one bladder member 24 may fail and the remaining bladder members 24 prevent the contact member 20 from collapsing into the upright member 18 unexpectedly during use.

The bladder member 24 can be filled with any suitable fluid, in either gaseous or liquid state. Many embodiments utilize air at ambient temperature and humidity as the fluid filling the bladder member 24. In embodiments where a bladder member 24 is filled with a fluid denser than ambient air such as water, the bladder member 24 offers more resistance to the player when the player impacts the contact member 20. In embodiments where the bladder member 24 is filled with a fluid that is less dense than ambient air such as neon gas, the bladder member 24 offers less resistance to a player. Any type of suitable fluid can be utilized within the bladder member 24, the examples listed herein are intended to be non-limiting and merely exemplary for explanatory purposes.

In other embodiments, a sensor system can be added to the leverage training sled system 100. The sensor system can be configured to read or record a value associated with the impact of a player onto the leverage training sled system 100. The sensor system can be embedded within the front padded member 36 to record the force of the impact that the player imparts to it. The sensor system can also be configured to output the reading of the force to a display in real time. The display can be communicatively connected to the sensor system via a physical wire, or it can be wirelessly connected.

The sensor system can also be communicatively coupled to a visual indicator light in the same manner as the sensor is communicatively coupled to the display. The visual indicator light can be set to display different sets of colors associated with different values recorded by the sensor system. As such, after a player imparts a force to the leverage training sled system 100, the visual indicator light will turn on and shine a color associated with the level of force that the player just imparted to the system. This provides instant feedback to both the player and the coach as to the player's performance. As a non-limiting example, for force values that are below a coach's expectations, the visual indicator light will shine red, yellow for values that meet expectations, and green for exceeding expectations. The visual indicator light is not limited to only three colors or those color criteria.

The sensor system can also be configured register which player is training on the leverage training sled system 100 at any point in time. The player would have a transmitter embedded within some portion of the players gear, for example, a football player's helmet, and the transmitter would transmit the player's information to the sensor system before the player begins training with the leverage training sled system 100. The sensor system can then output force values for specific players or specific training sessions to a database to further analyze the player's performance.

In embodiments that utilize an electric pump to set and maintain the internal pressure of the bladder member 24, the sensor system can also be communicatively coupled to the electric pump. In such embodiments, the sensor system can register which player is about to begin a training session with the leverage training sled system 100 and automatically adjust the internal pressure of the bladder member 24 to that specific player's ability level.

Alternatively, the coach can set the pressure of the electronic pump and have the difficulty level that bladder member 24 is set to displayed by a player facing display or light. Such a display could display different words or phrases associated with different internal pressures that the bladder member 24 can be set at.

Figure 8:
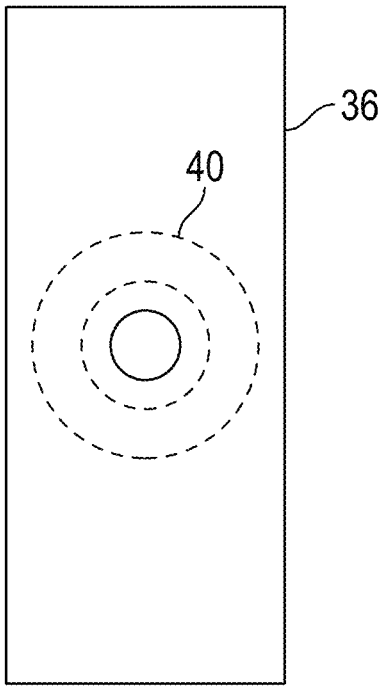
FIG. 8 is a front plan view of an embodiment of a padded member with a visual indicator according to the present disclosure.

Reference is now made to FIG. 8, which depicts an embodiment of a padded member 36 with a visual indicator or target 40 for the player to strike during training sessions. Certain embodiments of the contact member 20 include a padded member 36 to be affixed to the front of the contact member 20. The padded member 36 softens the impact imparted to the player during training and enhances player safety by reducing the force imparted to the player from the contact member 20. The padded member 36 can be affixed by hook and loop straps (e.g., Velcro), rope, zip-ties, fasteners such as self-tapping screws, or any other method suitable for mounting the padded member 36 to the front of the contact member 20. The target 40 can be of any design such that it indicates to the player where the optimal point to strike the padded member 36.

The various components of the leverage training sled system 100 can be connected to one another via welding techniques or with removable fasteners. In embodiments where the leverage training sled system 100 is assembled utilizing removable fasteners, the leverage training sled system 100 can be shipped to a user or destination unassembled, then assembled on site. Such a configuration can enhance the shipping efficiency of the leverage training sled system 100 as the leverage training sled system 100 can be safely packaged together in a more compact form factor than would otherwise be available if the leverage training sled system 100 was fully assembled.

In other embodiments, the leverage training sled system 100 can be pre-assembled prior to delivery to the site of its use. In such embodiments, the leverage training sled system 100 requires little if any set up by user and is in condition to begin being used in player training sessions quickly after delivery.

Although embodiments of a leverage training sled system 100 have been described in detail, those skilled in the art will also recognize that various substitutions and modifications may be made without departing from the scope and spirit of the appended claims.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but to the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A sled comprising:

a first elongate member separated by a distance from a second elongate member;

a cross member having a first end adjacent to a portion of the first elongate member and a second end adjacent to a portion of the second elongate member;

a contact member with a first end, wherein the first end is positioned adjacent to a portion of the cross member, wherein the contact member is positioned at a first angle relative to the cross member and is configured to pivot from the first angle to a second angle;

an upright member that extends from the portion of the cross member, the upright member having an upper edge spaced a vertical distance below an upper edge of the contact member; and a bladder member positioned at a height and between a portion of the upright member and a portion of the contact member.

2. The sled of claim 1, wherein the first and second elongate members are cylinders.

3. The sled of claim 1, further comprising a deck portion configured to be positioned above a second portion of the cross member.

4. The sled of claim 3, further comprising a brace that extends between the portion of the upright member and a portion of the deck portion.

5. The sled of claim 3, further comprising a friction increasing member connected to the deck portion.

6. The sled of claim 1, wherein the cross member is a plurality of cross members.

7. The sled of claim 1, wherein the bladder member is an adjustable air spring, the adjustable air spring configured to adjust a pressure of the bladder member from at least a first pressure to at least a second pressure.

8. The sled of claim 1, wherein the cross member is positioned substantially perpendicular to the first elongate member and the second elongate member.

9. The sled of claim 8, further comprising a pivot pin positioned adjacent to the portion of the cross member, wherein the pivot pin is configured to receive a lubricant.

10. A method of manufacturing a sled, comprising the steps of:

providing a first elongate member separated by a distance from a second elongate member;

providing a cross member having a first end adjacent to a portion of the first elongate member and a second end adjacent to a portion of the second elongate member;

providing a contact member with a first end, wherein the first end is positioned adjacent to a portion of the cross member, wherein the contact member is positioned at a first angle relative to the cross member and is configured to pivot from the first angle to a second angle;

providing an upright member that extends from the portion of the cross member, the upright member having an upper edge spaced a vertical distance below an upper edge of the contact member; and providing a bladder member that extends between a portion of the upright member and a portion of the contact member.

11. The method of claim 10, further comprising the step of providing a deck portion configured to be positioned above a second portion of the cross member.

12. The method of claim 10 wherein the cross member is a plurality of cross members.

13. The method of claim 10, wherein the bladder member is an adjustable air spring, the adjustable air spring configured to adjust a pressure of the bladder member from at least a first pressure to at least a second pressure.

14. A leverage training sled, comprising:

a first sliding member;

a second sliding member, the second sliding member spaced apart from the first sliding member by a length;

a support member connected to a portion of the first sliding member and to a portion of the second sliding member;

a collision member with a first end, the first end positioned adjacent to a portion of the support member, wherein the collision member is positioned at an angle relative to the support member;

a pivot member connected to the portion of the support member and an end of the collision member, the pivot member configured to receive a lubricant;

a column that extends substantially vertically from the portion of the support member, the column having an upper edge spaced a vertical distance below an upper edge of the collision member;

a bladder having an internal pressure and that extends between a portion of the column and a lower portion of the collision member; and a sensor configured to record a value associated with the collision member.

15. The leverage training sled of claim 14, wherein the value that is recorded by the sensor is a force.

16. The leverage training sled of claim 14, wherein the internal pressure of the bladder can be increased or decreased an amount.

17. The leverage training sled of claim 14, further comprising a padded member removably affixed to a front of the collision member.

18. The leverage training sled of claim 17, wherein the padded member includes a visual indicator on a front face of the padded member.

19. The leverage training sled of claim 14, wherein the bladder is a plurality of bladders.

20. The leverage training sled of claim 14, wherein the pivot member includes a removable pivot pin.

* * * * *